United States Patent [19]

Krasl

[11] 4,008,997

[45] Feb. 22, 1977

[54] SAGGER

[75] Inventor: George J. Krasl, St. Joseph, Mich.

[73] Assignee: Leco Corporation, St. Joseph, Mich.

[22] Filed: July 14, 1975

[21] Appl. No.: 595,845

[52] U.S. Cl. ..... 432/258; 165/9.1

[51] Int. Cl.[2] ..... F27D 5/00

[58] Field of Search ..... 432/253, 254, 258, 254.1, 432/254.2; 165/9.1

[56] References Cited

UNITED STATES PATENTS

| | | | |
|---|---|---|---|
| 287,469 | 10/1883 | Pulson et al. | 432/258 |
| 1,186,490 | 6/1916 | Moorcroft | 432/258 |
| 1,502,973 | 7/1924 | Armstrong | 432/254 |
| 1,566,070 | 12/1925 | Buckley | 432/258 |
| 2,144,374 | 1/1939 | Hoffman | 432/254 |
| 2,182,201 | 12/1939 | Harris | 432/254 |
| 2,297,286 | 9/1942 | Book | 432/258 |

*Primary Examiner*—John J. Camby

*Attorney, Agent, or Firm*—Price, Heneveld, Huizenga & Cooper

[57] ABSTRACT

A sagger including a plurality of identical side walls each including at one end a flange member extending the height of the side wall and at the opposite end, a flange-receiving socket extending the height of the side wall for receiving and positively interlocking the flange of an adjacent side wall such that a plurality of the side walls can be interfitted to complete the side construction of the sagger. The side walls include inwardly extending flanges for supporting a floor for the sagger.

10 Claims, 2 Drawing Figures

SAGGER

BACKGROUND OF THE INVENTION

The present invention relates to saggers employed in the firing of ceramic articles in a kiln.

Most saggers in commercial use today comprise rigid rectangular boxes of unitary construction with an open top for receiving the green ceramic articles placed therein for subsequent firing. Such saggers are adapted to be stacked vertically in the kiln during firing.

The difficulty with these conventional saggers resides in the fact that when subject to extreme temperature variations during use, they expand and contract and frequently warp and thus become very difficult to stack or even worse, break, rendering them unusable. It is not economically feasible to repair such saggers.

Some attempts have been made to relieve the difficulty encountered with unitary sagger construction. Such efforts are represented by U.S. Pat. Nos. 2,297,286 issued on Sept. 29, 1942 to A. R. Book; 1,186,490 issued on June 6, 1916 to H. Moorcroft and 287,469 issued on Oct. 30, 1883 to S. Pulson and M. L. Snow.

In such sagger construction, although some of the difficulties encountered with the unitary construction have been alleviated by providing multiple piece saggers having joints, the sagger construction either is so complex as to be very expensive to manufacture, or the loosely fitting joints of the individual pieces of the sagger do not provide sufficient stability for movement of the sagger during use, particularly when loaded with green pieces. As a result, the unitary sagger construction although undesirable, still remains the industry standard largely due to the failure of the prior art to provide an economical multiple section sagger which provides the structural characteristics required by the sagger and also overcomes the deficiencies of the single piece sagger in common use.

SUMMARY OF THE INVENTION

The apparatus of the present invention, however, overcomes the difficulties of the unitary sagger construction economically while providing an improved multisection sagger construction in which the sagger walls are identical pieces which interlock with adjacent walls in loosely interfitting cooperation permitting thermal expansion during firing without cracking or warping the sagger. Such construction thereby solves the problems of existent unitary construction saggers now in widespread use and yet remains a relatively inexpensive structure with the desired rigidity and structural characteristics required of saggers during their use.

Saggers embodying the present invention include a plurality of side walls, each including an enlarged, elongated flange extending along one end of the wall and an enlarged, elongated flange-receiving socket at the opposite end permitting adjacent side walls to be loosely interfitted in positive locking engagement with one another and means cooperating between the side walls and floor member associated therewith for holding the floor in position.

The various features, advantages and objects of the present invention will best be understood by reference to the following description thereof together with the accompanying drawings in which:

DETAILED DESCRIPTION OF THE PREFERRED EMBODIMENT

Figure 1:
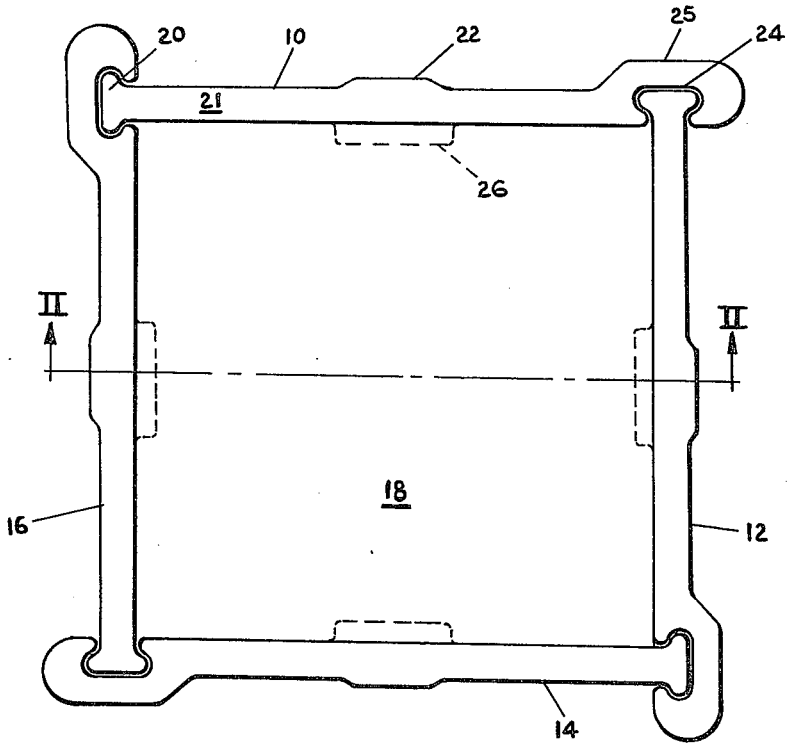
FIG. 1 is a plan view of a sagger embodying the present invention.

Referring now to the figures, the improved sagger construction of the present invention includes side walls 10, 12, 14 and 16 defining a generally square sagger construction with a loosely fitted square floor member 18 enclosing the bottom of the open topped sagger thereformed. Each of the side walls of the preferred embodiment is of identical construction and comprises a vertically extending, elongated, generally T-shaped flange 20 extending outwardly from opposite sides of the body of each of the side walls at one end and extending the entire height of the side walls. On the opposite end of each of the side walls there is formed an elongated, flange-receiving socket 24 which extends the entire height of the side wall and is generally of the same configuration as the T-shaped flange 20 only slightly larger. Socket 24 is formed in an enlarged reinforcing end 25 of the side wall to provide the required structural strength for the socket surrounded by the reinforcing portion 25. Each of the sockets opens in a direction orthogonal to the plane of the body of the side wall and slidably receives a flange of an adjacent side wall which is dropped vertically into place to define the four-wall, rectangular construction shown in the figures.

The socket is somewhat larger than the T-shaped flange and in the preferred embodiment, a gap 27 of approximately 0.020 inch extends around the entire periphery of each of the flanges between the outer flange surface and the inner surface of the socket. This gap can be varied somewhat with the gap size being sufficiently large to permit the sagger to be easily assembled and disassembled and yet, small enough such that once the sagger is assembled, the side walls are not overly loose and, therefore, wobbly, making transportation of the sagger difficult. In the preferred embodiment, the gap of approximately 0.020 inch provided the desired interfitting between each of the flanges 20 and the associated sockets 24.

Each of the side walls includes at its midsection a vertically extending reinforcing rib 22 providing structural strength to the side wall and in addition, an inwardly directed, integrally formed floor supporting flange 26. The floor 18, which is a square piece of flat ceramic material, is installed by lowering the floor piece between the side walls and which floor is then supported by the four inwardly directed flanges 26 of the side walls.

Figure 2:
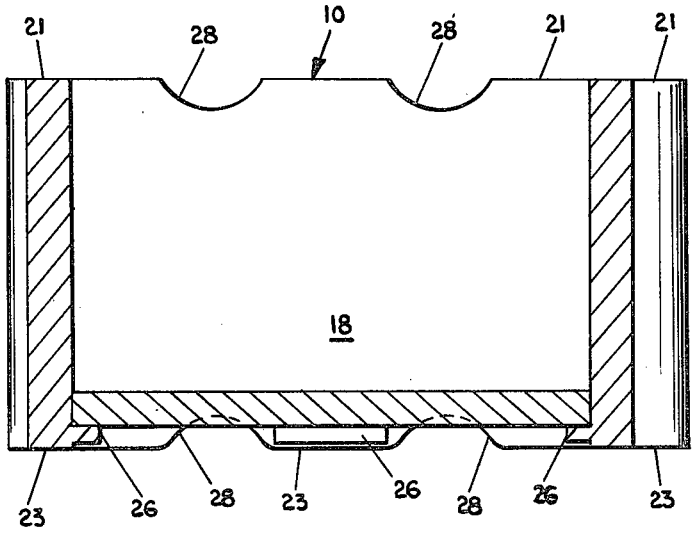
FIG. 2 is a cross-sectional view of the sagger shown in FIG. 1 taken along section line II-II of FIG. 1.

Generally flat supporting surfaces defined by the upper and lower surfaces 21 and 23, respectively, of the side walls permit the saggers to be vertically stacked during use. In order to provide escape passages for vapors during kiln firing of the green pieces positioned in the sagger, each of the sides includes a pair of spaced, upper and lower generally semicircular recesses 28, 29 respectively, formed therein, as seen in FIG. 2, which permits the escape of vapors when the saggers are vertically stacked.

Each of the side walls and the floor are manufactured of a heat-resistant ceramic material and in the preferred embodiment, the floor and side walls were injection molded using batches with the composition given in the following examples.

EXAMPLE 1

| Material | Percentage by Weight |
|---|---|
| G milled Zircon | 55.00 |
| Mullite — 14F | 40.00 |
| Mullite — 16 + 35M | 5.00 |
| Eskar R-50 | 2.23 of above |
| Eskar R-35 | 2.23 of above |
| Alrosperse 11p | 0.20 of above |
| Oleic acid | 0.25 of above |

EXAMPLE 2

| Material | Percentage by Weight |
|---|---|
| Al Mullite — 14 | 40.00 |
| Al Mullite — + 8 - 14 | 10.00 |
| T-61 $Al_2O_3$ — 325 | 35.00 |
| Univ. AlR Mullite — 325 | 15.00 |
| Eskar R-50 | 3.50 of above |
| Eskar R-35 | 3.50 of above |
| Alrosperse 11p | 0.20 of above |
| Oleic acid | 0.25 of above |
| Span 60 | 0.40 of above |

These mixtures were employed to make 300 pound batches mixed to form a slurry which was injection molded in a mold defining the desired side wall configuration. The green pieces were then fired in a conventional manner to complete their manufacture.

Other conventional forming techniques such as pressing or slip casting could be employed. Also, other conventional ceramic materials in common use can be employed. It is noted that the Al Mullite used for the Example 2 batch can be reclaimed material thus reducing the cost of the sagger.

The sagger is assembled for use by holding one of the side walls in a generally vertical position and lowering the adjacent side wall flange into the mating socket of the first side wall. The process is then repeated for the remaining two side walls and the floor is positioned between the side walls in a position resting on the flanges 26. The sagger is transported by gripping the diagonally opposite corners and lifting the sagger which maintains the relative positioning of the side walls and the floor when the sagger is being transported. In the event one of the side walls is inadvertently broken or damaged, a square side wall can be substituted without requiring replacement of the entire sagger. Thus, the sagger construction provides a readily repairable sagger inasmuch as the side walls are identical.

It will become apparent to those skilled in the art that various modifications to the preferred embodiment of the invention disclosed and described herein can be made. For example, the flanges and sockets may not be extended the entire height of the side walls, or may be segmented. Other floor supporting structure can likewise be employed. These and other changes to the preferred embodiment can be made without departing from the spirit or scope of the invention as defined by the appended claims.

The embodiments of the invention in which an exclusive property or privilege is claimed are defined as follows.

1. A sagger for the kiln firing of ceramic articles comprising:

a plurality of loosely interfitted side walls, each side wall including an elongated flange extending vertically along one end thereof and an elongated socket formed at the opposite end thereof and extending vertically along said opposite end, said flange and said socket shaped to slidably fit in a corresponding socket and flange, respectively, of adjacent side walls for interlocking said side walls such that they can be separated only by sliding said flange out of said socket; and floor means extending between said side walls to define an open topped sagger.

2. The sagger as defined in claim 1 wherein said flange is generally T-shaped and said socket is T-shaped and is slightly larger than said flange to provide a gap between a flange and an associated socket when the side walls are assembled.

3. The sagger as defined in claim 2 wherein each of said side walls is of identical construction.

4. The sagger as defined in claim 3 wherein each of said side walls includes an inwardly directed flange near a bottom edge thereof for supporting a generally rectangular floor member between said side walls.

5. The sagger as defined in claim 4 wherein each of said side walls includes upper and lower recesses permitting vapor to escape when the sagger is in use for firing ceramic articles.

6. The sagger as defined in claim 5 wherein said side walls and said floor are made of a ceramic material.

7. An improved sagger side wall construction in which identical side walls are loosely interfitted and positively locking with adjacent side walls to define the side wall construction of the sagger which further includes floor means interengaging with the side walls, each of said side walls comprising: an elongated, generally planar rectangular ceramic plate having a T-shaped flange extending vertically along one end thereof, the opposite end being enlarged and including a generally T-shaped, elongated socket extending vertically along said opposite end and opening in a direction orthogonal to the plane of said member.

8. The sagger side wall construction as defined in claim 7 wherein said side wall is made of a ceramic material including mullite.

9. The sagger side wall construction as defined in claim 8 wherein said side wall further includes a flange extending outwardly from said side wall near one edge thereof approximately midway between said flange and said socket to define a floor supporting member.

10. The sagger as defined in claim 9 wherein said socket is slightly larger than said T-shaped flange such that a gap exists between a T-shaped flange and an associated socket, which gap is approximately 0.020 inch.

* * * * *